US005292998A

United States Patent [19]

Knapp

[11] Patent Number: 5,292,998

[45] Date of Patent: Mar. 8, 1994

[54] ELECTRONIC GUITAR EQUIPPED WITH ASYMMETRICAL HUMBUCKING ELECTROMAGNETIC PICKUP

[75] Inventor: Leo J. Knapp, North Hollywood, Calif.

[73] Assignee: Yamaha Corporation, Hamamatsu, Japan

[21] Appl. No.: 861,292

[22] Filed: Mar. 31, 1992

[51] Int. Cl.[5] ..... G10H 3/18

[52] U.S. Cl. ..... 84/726

[58] Field of Search ..... 84/725, 726, 728

[56] References Cited

U.S. PATENT DOCUMENTS

| | | | |
|---|---|---|---|
| 4,026,178 | 5/1977 | Fuller . | |
| 4,463,648 | 8/1984 | Fender | 84/725 |
| 4,501,185 | 2/1985 | Blucher . | |
| 4,581,974 | 4/1986 | Fender | 84/725 |
| 4,581,975 | 4/1986 | Fender | 84/725 |
| 4,809,578 | 3/1989 | Lace, Jr. | 84/725 |
| 5,111,728 | 5/1992 | Blucher et al. | 84/726 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electric guitar is equipped with an asymmetric humbucking electromagnetic pickup for strings stretched thereover, and the asymmetric humbucking electromagnetic pickup has two comb-shaped core members with a predetermined pitch respectively wound by coil members, wherein the two comb-shaped core members are staggered by half of the pitch so that each of the strings are different in distance from the two comb-shaped core members, thereby allowing the asymmetric humbucking electromagnetic pickup to convert any high-order harmonic component to a signal component without sacrifice of anti-noise characteristics.

15 Claims, 8 Drawing Sheets

ELECTRONIC GUITAR EQUIPPED WITH ASYMMETRICAL HUMBUCKING ELECTROMAGNETIC PICKUP

FIELD OF THE INVENTION

This invention relates to an electric guitar and, more particularly, to an electromagnetic pickup device of the electric guitar.

DESCRIPTION OF THE RELATED ART

An electromagnetic pickup is one of the indispensable components of the electric guitar, and the electromagnetic pickup produces electric signals on the basis of vibrations produced in the strings upon plucking. Various kinds of electromagnetic pickup are known and provided with electric guitars.

A single-coil electromagnetic pickup is popular with players, and is illustrated in FIG. 1 of the drawings. The single-coil electromagnetic pick up comprises a coil 1 wound around a permanent magnet pole 2, and creates magnetic field 3 therearound. The magnetic field 3 is symmetrical with respect to a center plane 5,,and the center axis of the permanent magnet pole 2 extends along the center plane 5. While a string 4 is stationary with respect to the single-coil electromagnetic pickup, an electric signal produced in the single-coil electromagnetic pickup is substantially flat. However, when the string 4 is plucked, the string 4 vibrates across the magnetic field 3, and the electric signal alternates as similar to the vibrations. One of the attractive characteristics of the single-coil electromagnetic pickup is clear or sharp sounds produced from the electric signals. However, noise is liable to ride on the electric signal produced by the single-coil electromagnetic pickup, because the coil 1 tends to serve as an antenna.

Another popular electromagnetic pickup is known as a humbucking electromagnetic pickup, and a typical example of the humbucking electromagnetic pickup is illustrated in FIG. 2. The humbucking electromagnetic pickup is of tandem coil unit. Namely, a first coil 6 is wound on a first pole member 7 made of iron, and a second coil 8 is wound on a second pole member 9 made of iron. The second coil 8 is wound in the opposite direction to that of the first coil 6, and the first and second coils 6 and 8 are coupled in series with each other. The first pole member 6 is equal in dimensions to the second pole member 9, and a permanent magnet member 10 is held in contact with the first and second pole members 7 and 9. The humbucking electromagnetic pickup thus arranged is symmetrical with respect to a plane 11, and creates magnetic field 12 also symmetrical with respect to the plane 11. The humbucking electromagnetic pickup is less affectable by noise, because the first and second coils cancel out noise components of an electric signal produced therein. However, sounds produced from the electric signal are less clear and less sharp rather than those produced by the single-coil electromagnetic pickup.

A humbucking electromagnetic pickup 13 shown in FIG. 3 is scaled down, and is as small as the single-coil pickup shown in FIG. 1. Even though the humbucking electromagnetic pickup 3 is scaled down, the components are similar to those of the humbucking electromagnetic pickup shown in FIG. 2, and are labeled with the same references designating the corresponding components. The scaled down humbucking electromagnetic pickup 13 is compatible with the single-coil electromagnetic pickup. However, sounds produced from an electromagnetic signal of the pickup 13 are closer to the sounds of the humbucking electromagnetic pickup shown in FIG. 2 rather than those of the single-coil pickup. In other words the sounds are less clear and less sharp.

FIG. 4 shows a stacked type humbucking electromagnetic pickup which largely comprises a single-coil electromagnetic pickup 14 coupled with a noise canceler 15 implemented by a single-coil unit. The stacked type humbucking electromagnetic pick up is also compatible with the standard single-coil electromagnetic pickup shown in FIG. 1. However, sounds are unclear, because the electric signal passes through the noise canceler 15.

SUMMARY OF THE INVENTION

It is therefore an important object of the present invention to provide an humbucking electromagnetic pickup which allows clear sounds to be produced without sacrifice of anti-noise characteristics.

The present inventor has analyzed sounds produced by using a humbucking electromagnetic pickup, and has discovered the reason why the sounds are less clear. The analysis teaches that the sounds are not clear throughout the frequency range. If the frequency of vibrations are indicated by plots X1 and X2 of FIG. 5A, the coil units U1 and U2 of the humbucking electromagnetic pickup double the magnitude of the electric signal, because the vibrations X1 and X2 are in-phase for both coil units U1 and U2. On the other hand, if the vibrations are anti-phase as indicated by plots X3 of FIG. SB, the coil units U1 and U2 tend to cancel the electric signal, and the magnitude of electric signal is relatively small. In general, vibrations produced upon plucking contain not only a basic frequency but also harmonic components, and higher-order harmonic components are much liable to be anti-phase. For this reason, the prior art humbucking electromagnetic pickup eliminates or decreases the signal components for the higher-order harmonic components, and a listener feels the sounds produced from the electric signal are less clear.

On this basis of the discovery, the present inventor purposes to make the signal components of coil units unbalanced and, accordingly, to shape tandem pole members in an asymmetrtic configuration.

In accordance with one aspect of the present invention, there is provided an electric string musical instrument comprising a) a solid body, b) a neck portion projecting from the solid body, c) at least one string stretched over the solid body and the neck portion, and d) an electromagnetic pickup device mounted on the solid body, and located under the at least one string for producing an electric signal indicative of vibrations of the at least one string, the electromagnetic pickup device comprising d-1) a first core member having a first surface portion directed to the at least one string, d-2) a first coil member wound on the first core member, d-3) a second core member having a second surface portion directed to the at least one string, the second surface portion being spaced apart from the at least one string by a gap different from a gap between the first surface portion and the at least one string, d-4) a second coil member wound on the second core member, and d-5) a permanent magnetic member provided in association with the first and second core members, and magnetizing the first and second core members.

In accordance with another aspect of the present invention, there is provided a humbucking electromagnetic pickup provided for at least one string, comprising: a) a first core member having a first surface portion exposed to the at least one string; b) a first coil member wound on the first core member; c) a second core member having a second surface portion directed to the at least one string, the second surface portion being spaced apart from the at least one string by a gap different from a gap between the first surface portion and the at least one string; d) a second coil member wound on the second core member; and e) a permanent magnetic member provided in association with the first and second core members, and magnetizing the first and second core members.

BRIEF DESCRIPTION OF THE DRAWINGS

The features and advantages of the electric guitar according to the present invention will be more clearly understood from the following description taken in con junction with the accompanying drawings in which.

DESCRIPTION OF THE PREFERRED EMBODIMENT

Figure 1:
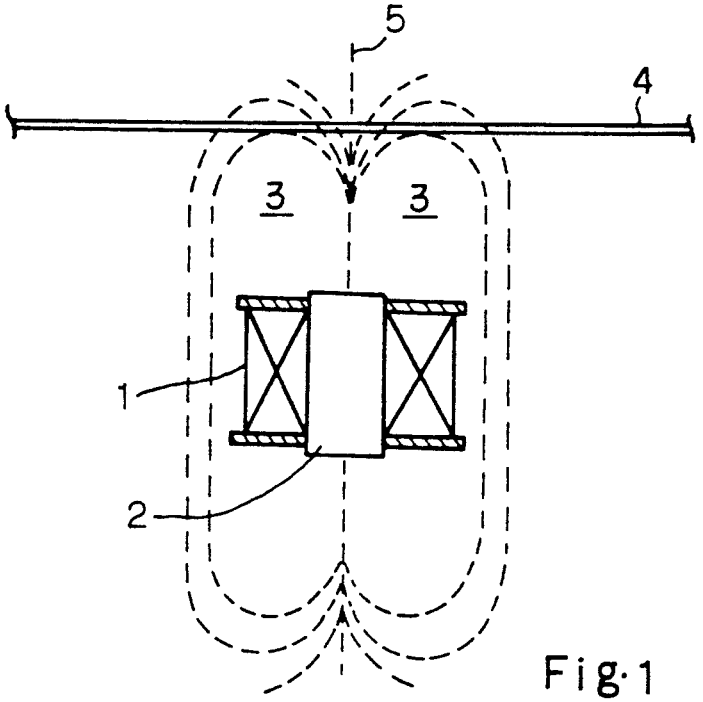
Fig. 1 PRIOR ART
FIG. 1 is a cross sectional view showing the structure of the prior art single-coil electromagnetic pickup.
Figure 2:
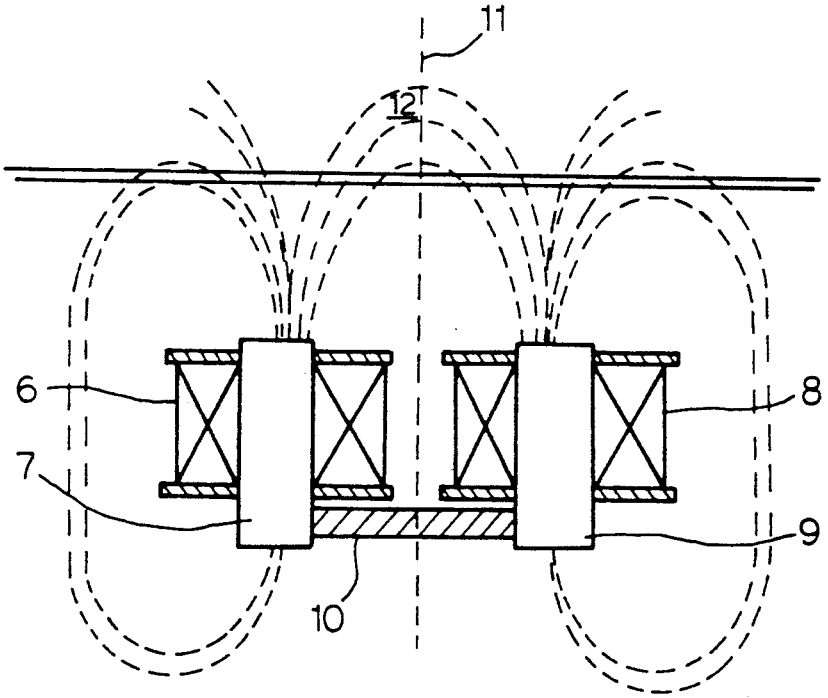
Fig. 2 PRIOR ART
FIG. 2 is a cross sectional view showing the structure of the prior art humbucking electromagnetic pickup.
Figure 3:
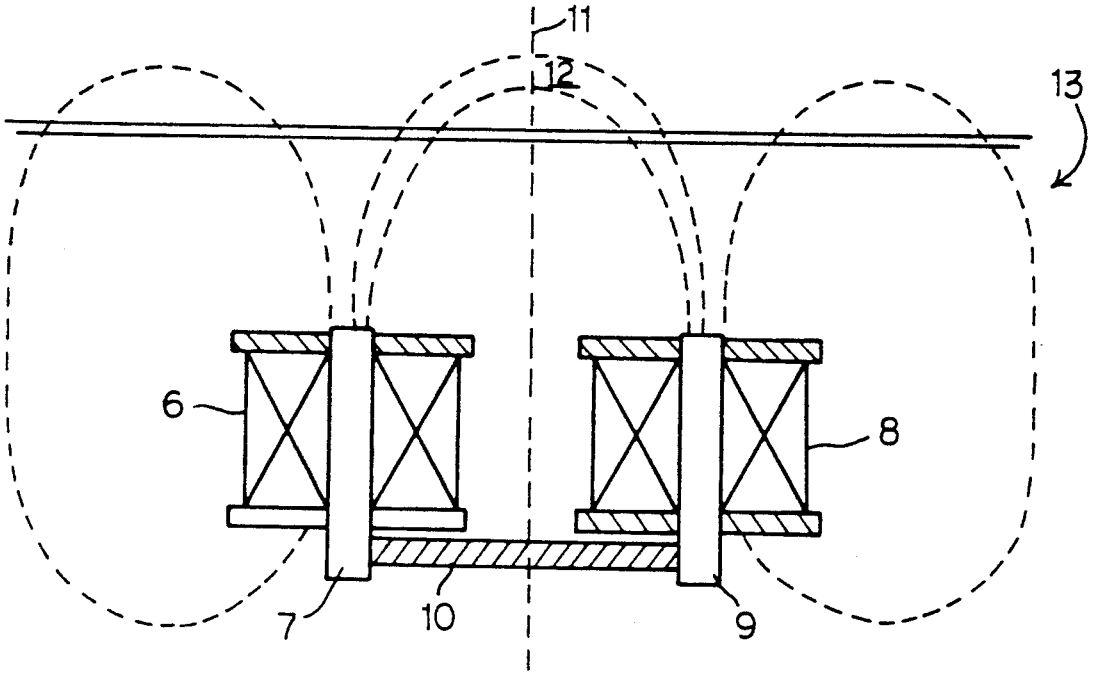
Fig. 3 PRIOR ART
FIG. 3 is a cross sectional view showing the structure of the prior art scaled-down humbucking electromagnetic pickup.
Figure 4:
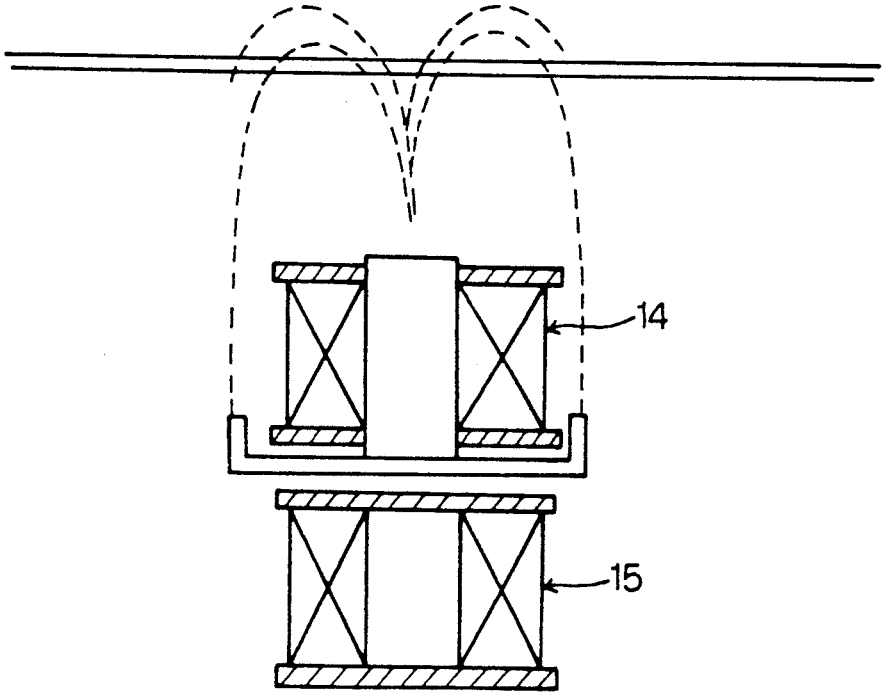
Fig. 4 PRIOR ART
FIG. 4 is a cross sectional view showing the structure of the prior art stacked type humbucking electromagnetic pickup.
Figure 5A:
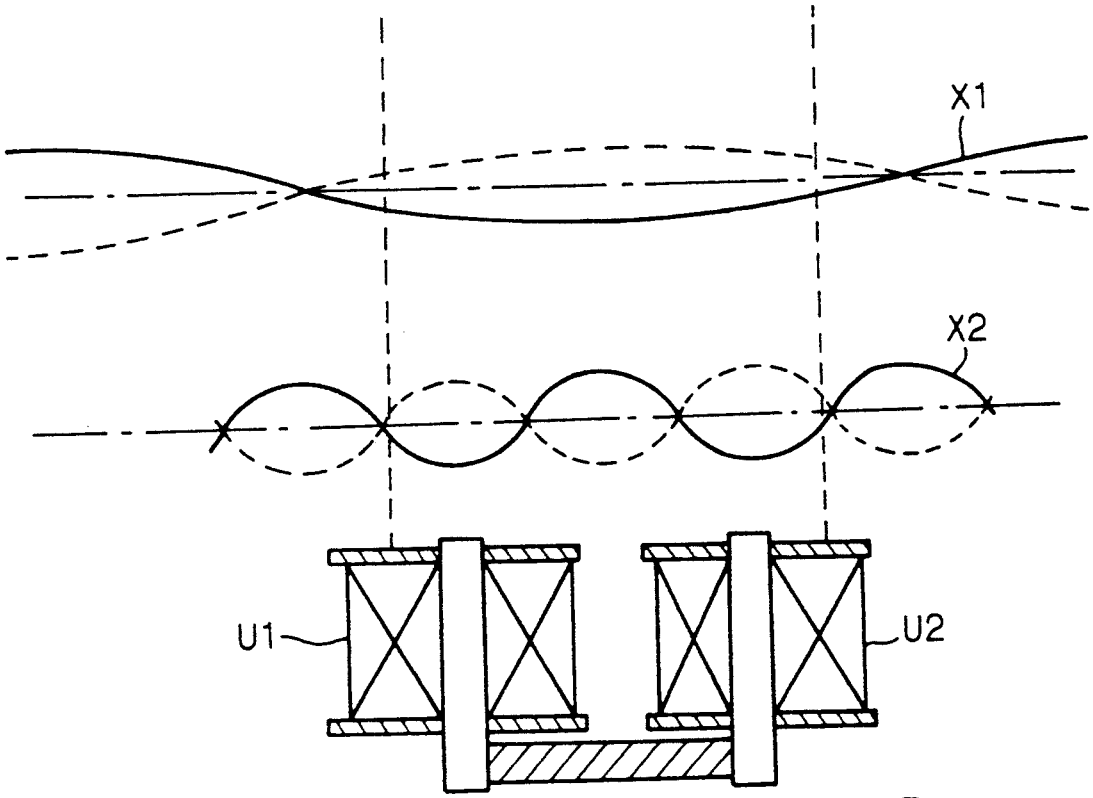
Fig. 5A PRIOR ART
FIGS. 5A and SB are cross sectional views describing analysis for unclearness of sounds produced by using the humbucking electromagnetic pickup.
Figure 5B:
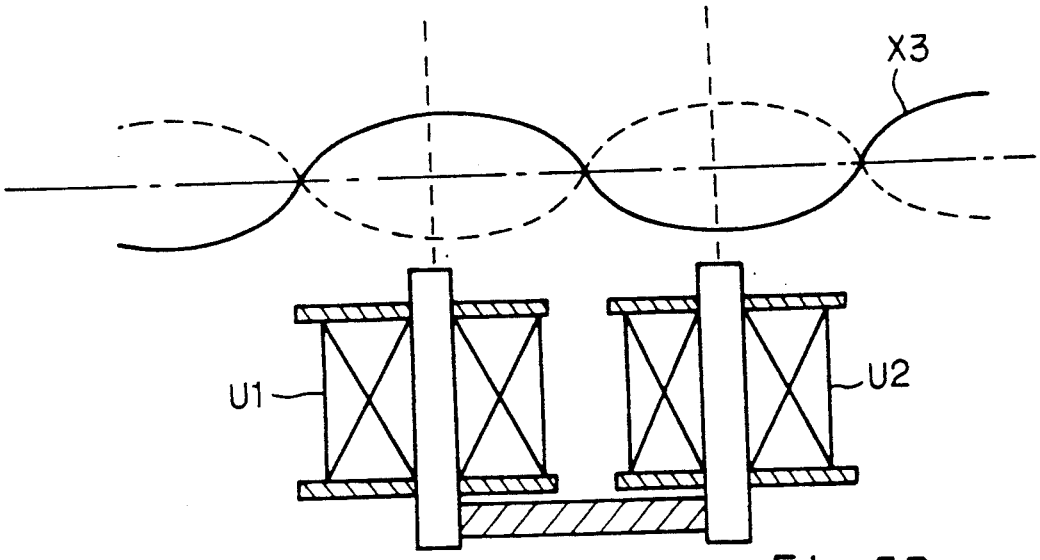
Fig. 5B PRIOR ART
Figure 6:
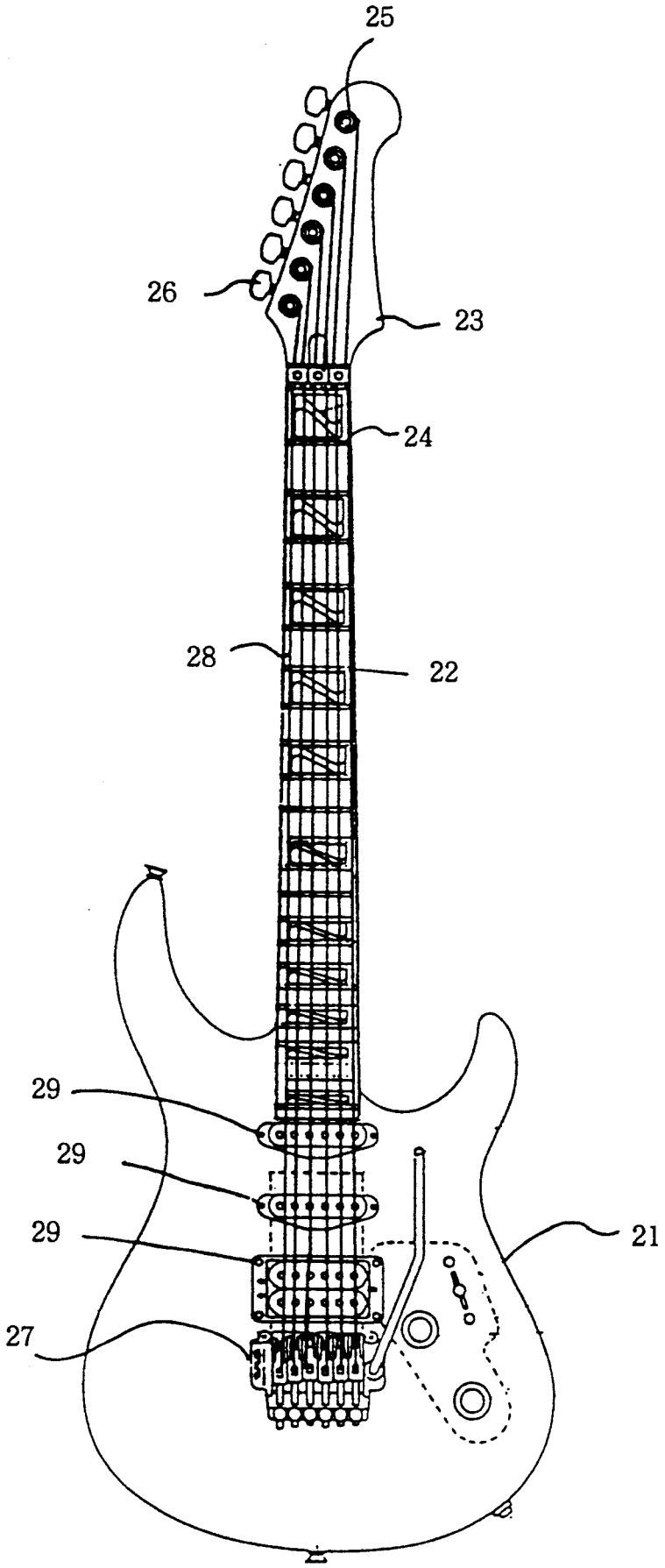
FIG. 6 is a front view showing the arrangement of an electric guitar according to one embodiment of the present invention.

Referring to FIG. 6 of the drawings, an electric guitar in accordance with one embodiment of the present invention comprises a solid body 21, a neck 22 projecting from the solid body 21, and a head 23 fixed to the leading end of the neck 22. A plurality of frets 24 are embedded into the neck 22 at spacings, and string guides 25 are provided on the front surface of the head 25. Pe~s 26 are further provided on the side surface of the head 23, and are turnable with respect to the head 23. A tremolo unit 27 is swingably mounted on the solid body 21, and strings 28 between the tremolo unit 27 and the string guides 25. The tension of each of the strings 28 may be regulated by the associated peg 26. An asymmetric humbucking electromagnetic pickup 29 is further embedded into the solid body 21, and is located under the strings 28 between the tremolo unit 27 and the neck 22.

Figure 7:
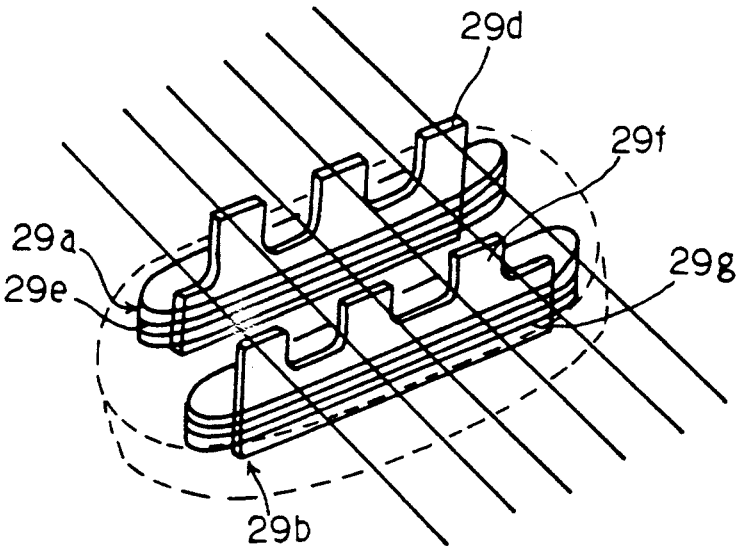
FIG. 7 is a perspective view showing the structure of an asymmetric humbucking electromagnetic pickup incorporated in the electric guitar shown in FIG. 6.
Figure 8:
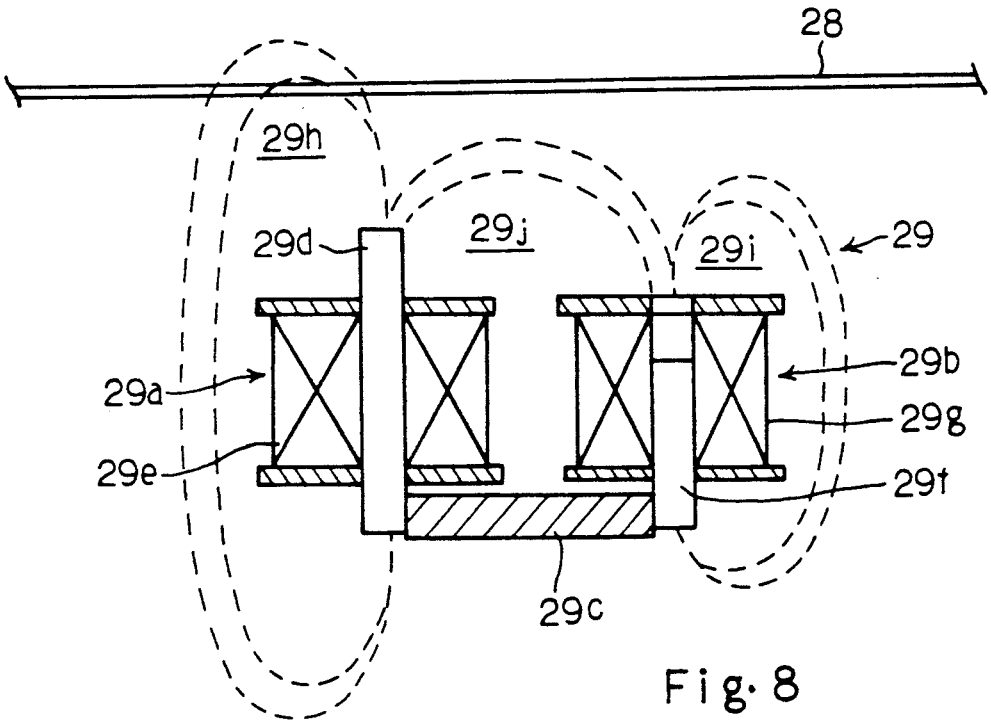
FIG. 8 is a cross sectional view showing the structure according to one embodiment of an asymmetric humbucking electromagnetic pickup.
Figure 9A:
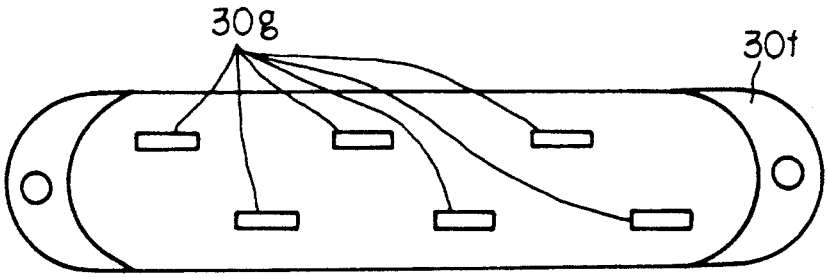
FIG. 9A to 9E are views showing the configurations of component parts according to one embodiment of an asymmetric humbucking electromagnetic pickup.
Figure 9B:
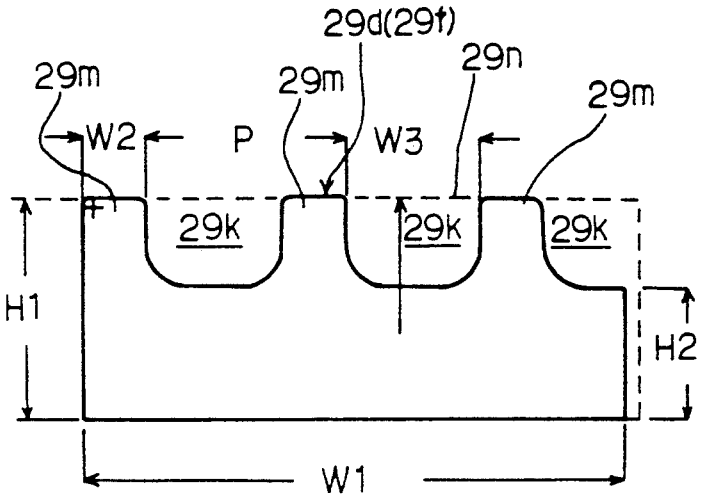
Figure 9C:
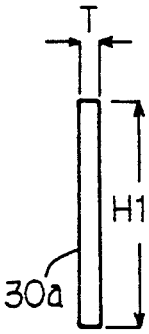
Figure 9D:
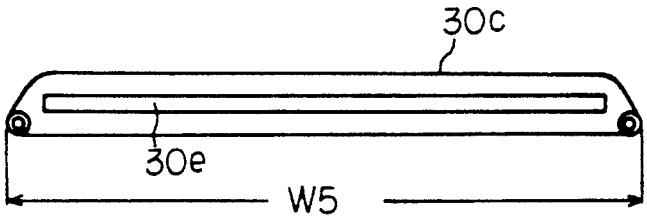
Figure 9E:
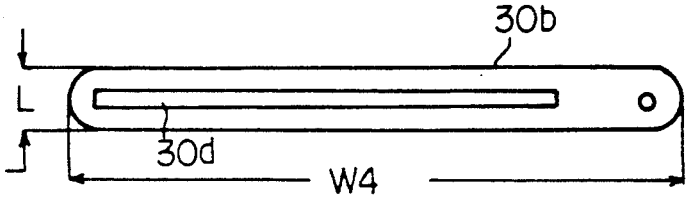

As will be better seen from the embodiment illustrated for example in FIGS. 7 and 8, the asymmetric humbucking electromagnetic pickup 29 includes first and second coil unit 29*a* and 29*b* associated with a permanent magnetic member 29*c*. The first coil unit 29*a* has a first core member 29*d* held in contact with the permanent magnetic member 29*c* and a first coil 29*e* wound on the first core member 29*d* Similarly, the second coil unit 29*b* has a second core member 29*f* held in contact with the permanent magnetic member 29*c* and a second coil 29*g* wound on the second core member 29*f*. The first and second coils 29*e* and 29*g* are coupled in series with each other, however, the first coil 29*e* is opposite in winding direction to the second coil 29*g*. The first and second core members 29*d* and 29*f* are shaped into comb configuration. However, the second core member 29*f* is staggered with respect to the first core member 29*d* by a half pitch, and, for this reason, the top surface of the first core member 29*d* under one of the strings 28 is higher than that of the second core member 29*f* under the same string as will be understood from FIG. 8.

By virtue of this asymmetric structure, the first coil unit 29*a* creates a first magnetic field 29*h* which has a different pattern than a second magnetic field 29*i* created by the second coil unit 29*b* and a third magnetic field 29*j* created by both of the first and second magnetic units 29*a* and 29*b*. The first magnetic field 29*h* widely extends, and the associated string crosses relatively high flux density. However, the second and third magnetic fields 29*i* and 29*j* are less extensible than the first magnetic field 29*h*, and the associated string crosses relatively low flux density areas. This results in that the first coil unit 29*a* produces a larger amount of current than that of the second coil unit 29*b*. For this reason, even if some of the high-order harmonic components are in-phase, the asymmetric humbucking electromagnetic pickup according to the present invention does not perfectly cancel the signal components for the high-order harmonic components, and, accordingly, converts not only the basic wave frequency but also all the harmonic components into an electric signal. When the electric signal is supplied to an audio system (not shown), a listener will feel that the sounds produced from the electric signal are clear and sharp. However, since the first and second coils 29*e* and 29*g* serve as antennas for noises, the noises are directly applied to the first and second coil units 29*a* and 29*b*, and the first and second coils 29*e* and 29*g* perfectly cancel the signal components for the noises.

FIGS. 9A to 9E illustrate component parts of the asymmetric humbucking electromagnetic pickup 29 in accordance with one embodiment of the present invention. Each of the first and second comb-shaped core members 29*d* and 29*f* is about 55.56 millimeters in width and about 23.11 millimeters in the maximum height. Valleys 29*k* and mountains 29*m* are repeatedly formed on each comb-shaped core member 29*d* or 29*f*, and an envelop line 29*n* of the mountains 29*m* are slightly curved at radius of curvature 457.20 millimeters. The bottom surfaces of the valleys 29k are spaced from the lowest surface of each comb-shaped core member 29d or 29f by distance H2 of 13.44 millimeters. The width W2 of each mountain 29m is about 6.35 millimeter each valley 29k is about 13.97 millimeters in width W3. Thus, each pitch P is the total sum of the widths W2 and W3, and is as large as 20.32 millimeters.

In order to regulate the pitch P in one embodiment of the present invention a spacer member 30a is provided for each comb-shaped core member 29d or 29f, and is attached to a side surface of each comb-shaped core member 29d or 29f. The spacer 30a and, accordingly, each comb-shaped core member 29d or 29f are about 1.59 millimeters in thickness T. Upper and lower retaining members 30b and 30c are further provided for each comb-shaped core member 29d or 29f, and each comb-shaped core member 29d or 29f is inserted into slits 30d and 30e respectively formed in the upper and lower retaining members 30b and 30c. The upper retaining member 30b is about 61.91 millimeters in width W4, and the lower retaining member 30c has width W5 of about 65.21 millimeters. The upper retaining member 30b is about 6.35 millimeters in length L. A cap member 30f is further provided for the comb-shaped core members 29d and 29f, and the cap member 30f has short slits 30g arranged in staggered manner. The short slits 30g allow the mountains 29m of the comb-shaped core members 29d and 29f to project therefrom.

Figure 10A:
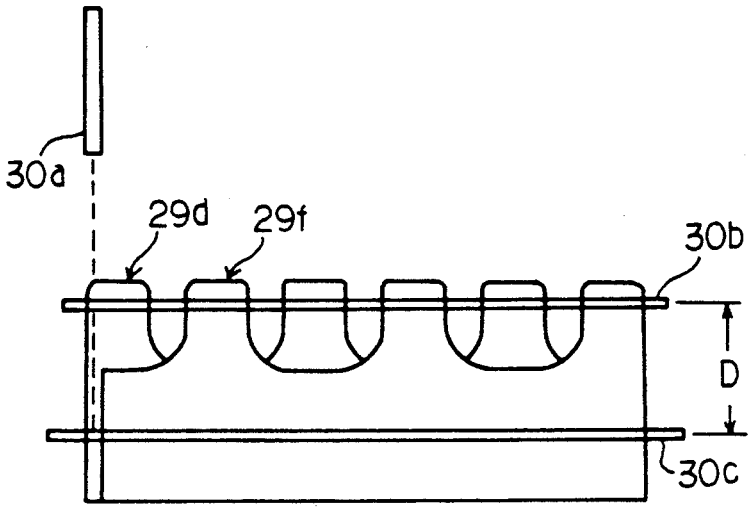
FIGS. 10A is a front view showing the component parts of one embodiment of the present invention partially assembled.
Figure 10B:
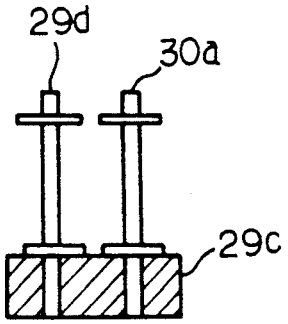
FIG. 10B is a side view showing the component parts of one embodiment of the present invention partially assembled.

When the component parts 29d, 29f, 30a, 30b, 30c and 30f are assembled, the comb-shaped core members 29d and 29f are firstly inserted into the slits 30d and 30e of the associated upper and lower retaining members 30d and 30e, and the spacer 30a fills gap formed between the upper and lower retaining members 30b and 30c and the associated comb-shaped core member 29d or 29f as illustrated for example, in FIGS. 10A and 10B. Though not shown in FIGS. 10A and 10B, the first and second coils 29e and 29g may be respectively wound on the associated first and second comb-shaped core members 29d and 29f 3250 times. In this instance, the upper and lower retaining members 30b and 30c are spaced apart from each other by distance D of about 12.70 millimeters. The first and second comb-shaped core members 29d and 29f are fixed to the permanent magnetic member 29c as shown in FIG. 10B.

Figure 11A:
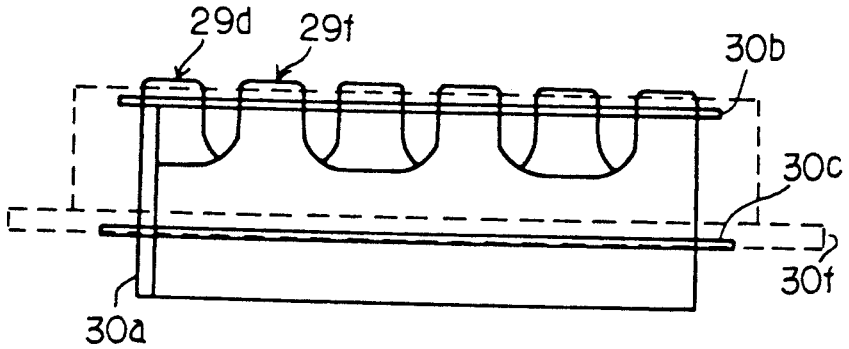
FIG. 11A is a front view showing the component parts of one embodiment of the present invention completely assembled.
Figure 11B:
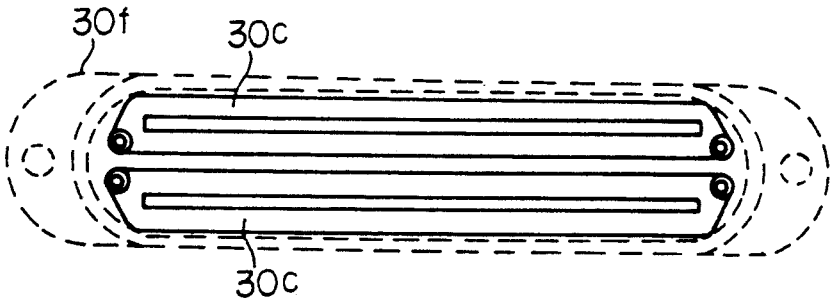
FIG. 11B is a plan view showing the component parts of one embodiment of the present invention completely assembled.

Finally, the cap member 30f may cover the first and second comb-shaped core members 29d and 29f assembled as shown in FIG. 10A, and the resultant structure is shown in FIG. 11A. The asymmetric humbucking electromagnetic pickup 29 thus assembled is partially embedded into the solid body 21. The lower retaining members 30c are bolted to the permanent magnetic member 29c as shown in FIG. 11B, and the cap member 30f is further bolted to the solid body 21.

As will be appreciated from the foregoing description, the electric guitar according to the present invention is equipped with the asymmetric humbucking electromagnetic pickup 29, and the asymmetric electromagnetic pickup 29 faithfully converts not only the basic wave frequency but also the high-order harmonic components into an electric signal. Therefore, the electric signal can allow an audio system to retrieve original mechanical vibrations, and the sounds thus produced are clear and sharp. Moreover, the first and second coils have the same turns, and can perfectly cancel noise components directly applied thereto. Therefore, the asymmetric humbucking electromagnetic pickup according to the present invention produces clear and sharp sounds without sacrifice of anti-noise characteristics.

Although particular embodiments of the present invention have been shown and described, it will be obvious to those skilled in the art that various changes and modifications may be made without departing from the spirit and scope of the present invention. For example, the humbucking electromagnetic pickup according to the present invention is applicable for any string musical instrument such as, for example, an electric bass or an electric violin.

What is claimed is:

1. An electric string musical instrument comprising:

a solid body;

a neck portion projecting from the solid body;

a predetermined number of first strings stretched over the solid body and the neck portion;

a predetermined number of second strings stretched over the solid body and the neck portion; and an electromagnetic pickup device mounted on the solid body, and located under the first and second strings, for producing electric signals indicative of vibrations of at least one of the strings, the electromagnetic pickup device including a) a first core member defining a first upper surface portion and a first lower surface portion, the first upper surface portion facing one of the first strings and the first lower surface portion facing one of the second strings, the first upper surface portion and the first string defining a first spacing and the first lower surface portion and the second string defining a second spacing, the second spacing being greater than the first spacing, the first upper surface portion and the first lower surface portion having associated magnetic fields, wherein the magnetic field produced by the first lower surface portion is substantially less extensible than the magnetic field produced by the first upper surface portion, b) a first coil member wound on the first core member, c) a second core member, in spaced relation to the first core member, defining a second upper surface portion and a second lower surface portion, the second upper surface portion facing one of the second strings and the second lower surface portion facing one of the first strings, the second upper surface portion and the second string defining a third spacing and the second lower surface portion and the first string defining a fourth spacing, the fourth spacing being greater than the third, wherein the second core member is a mirror-image of the first core member, and is arranged parallel to the first core member and staggered by at least the width of the first upper surface portion of the first core member, the second upper surface portion and the second lower surface portion having associated magnetic fields, wherein the magnetic field produced by the second lower surface portion is substantially less extensible than the magnetic field produced by the second upper surface portion;

d) a second coil member wound on the second core member, and e) a permanent magnetic member associated with the first and second core members, and magnetizing the first and second core members.

2. An electric string musical instrument as set forth in claim 1, wherein each of the first and second core members comprise at least two upper surface portions defining a pitch, the first core member being staggered by half of the pitch with respect to the second core member.

3. An electric string musical instrument as set forth in claim 1, wherein the first and second coil members are wound in opposite directions and have an approximately equal number of turns.

4. An electric string musical instrument as set forth in claim 1, wherein each of the second strings is located between a pair of the first strings.

5. A humbucking electromagnetic pickup for use with a predetermined number of first strings and a predetermined number of second strings, the humbucking electromagnetic pickup comprising:

a first core member defining a first upper surface portion and a first lower surface portion, the first upper surface portion facing one of the first strings and the first lower surface portion facing one of the second strings, the first upper surface portion and the first string defining a first spacing and the first lower surface portion and the second string defining a second spacing, the second spacing being greater than the first spacing, the first upper surface portion and the first lower surface portion having associated magnetic fields, wherein the magnetic field produced by the first lower surface portion is substantially less extensible than the magnetic field produced by the first upper surface portion, a first coil member wound on the first core member, a second core member, in spaced relation to the first core member, defining a second upper surface portion and a second lower surface portion, the second upper surface portion facing one of the second strings and the second lower surface portion facing one of the first strings, the second upper surface portion and the second string defining a third spacing and the second lower surface portion and the first string defining a fourth spacing, the fourth spacing being greater than the third spacing, wherein the second core member is a mirror-image of the first core member, and is arranged parallel to the first core member and staggered from the first core member by at least the width of the first supper surface portion of the first core member, the second upper surface portion and the second lower surface portion having associated magnetic fields, wherein the magnetic field produced by the second lower surface portion is substantially less extensible than the magnetic field produced by the second upper surface portion, a second coil member wound on the second core member, and a permanent magnetic member associated with the first and second core members, and magnetizing the first and second core members.

6. A humbucking electromagnetic pickup as set forth in claim 5, wherein each of the second strings is located between a pair of the first strings.

7. A humbucking electromagnetic pickup for use with an instrument having a predetermined number of first strings and a predetermined number of second strings, the humbucking electromagnetic pickup comprising:

a first core member defining a plurality of first upper portions and first lower portions integral with the first upper portions, each of the first upper portions arranged opposite one of the first strings and each of the first lower portions arranged opposite one of the second strings, a first coil member wound on the first core member, a second member defining a plurality of second upper portions and second lower portions integral with the second upper portions, each of the second upper portions arranged opposite one of the second strings and the second lower portion arranged opposite one of the first strings, wherein the second core member is a mirror-image of the first core member, and is arranged parallel to the first core member and staggered by at least the width of one of the first upper portions of the first core member, a second coil member wound on the second core member, and a magnetic member associated with the first and second core members.

8. A humbucking electromagnetic pickup as set forth in claim 7, wherein first and second amounts of current are produced by the first and second core members, respectively, in response to a vibration of the one of the first strings, the amount of current produced by the first core member being substantially greater than the amount of current produced by the second core member.

9. A humbucking electromagnetic pickup as set forth in claim 7, wherein first and second amounts of current are produced by the first and second core members, respectively, in response to a vibration of the one of the second strings, the amount of current produced by the first core member being substantially less than the amount of current produced by the second core member.

10. A humbucking electromagnetic pickup as set forth in claim 7, wherein each of the first and second core members comprise at least two upper portions defining a pitch, the first core member being staggered by half of the pitch with respect to the second core member.

11. A humbucking electromagnetic pickup as defined in claim 7, wherein the first and second coil members are wound in opposite directions and have an approximately equal number of turns.

12. The electric string musical instrument of claim 1, wherein the first upper surface portion is formed integrally with the first lower surface portion, and the second upper surface portion is formed integrally with the second lower surface portion.

13. The electric string musical instrument of claim 5, wherein the first upper surface portion is formed integrally with the first lower surface portion, and the second upper surface portion is formed integrally with the second lower surface portion.

14. An electric string musical instrument as set forth in claim 1, wherein the first and second coil members are wound in opposite directions.

15. A humbucking electromagnetic pickup as defined in claim 7, wherein the first and second coil members are wound in opposite directions.

* * * * *